US005555861A

United States Patent [19]

Mayr et al.

[11] Patent Number: 5,555,861

[45] Date of Patent: Sep. 17, 1996

[54] DRIVE FOR GAS EXCHANGE VALVES, PREFERABLY INLET VALVES FOR RECIPROCATING INTERNAL COMBUSTION ENGINES

[75] Inventors: Bertold Mayr, Gauting; Leopold Müller, Chemnitz; Joachim Böhme, Lichenwalde, all of Germany

[73] Assignee: IAV Motor GmbH, Chemnitz, Germany

[21] Appl. No.: 318,832

[22] PCT Filed: Apr. 22, 1993

[86] PCT No.: PCT/DE93/00357

§ 371 Date: Oct. 14, 1994

§ 102(e) Date: Oct. 14, 1994

[87] PCT Pub. No.: WO93/22543

PCT Pub. Date: Nov. 11, 1993

[30] Foreign Application Priority Data

| | | | |
|---|---|---|---|
| Apr. 27, 1992 | [DE] | Germany | 42 13 856.6 |
| Jul. 31, 1992 | [DE] | Germany | 42 25 796.4 |
| Dec. 28, 1992 | [DE] | Germany | 42 44 287.7 |

[51] Int. Cl.[6] ..... F01L 13/00; F01L 1/14

[52] U.S. Cl. ..... 123/90.16; 123/90.55; 123/198 F

[58] Field of Search ..... 123/90.15, 90.16, 123/90.17, 90.27, 90.48, 90.52, 90.55, 198 F

[56] References Cited

U.S. PATENT DOCUMENTS

| | | | |
|---|---|---|---|
| 5,090,364 | 2/1992 | McCarroll et al. | 123/90.16 |
| 5,287,830 | 2/1994 | Dopson et al. | 123/90.16 |
| 5,361,733 | 11/1994 | Spath et al. | 123/90.16 |
| 5,402,756 | 4/1995 | Bohme et al. | 123/90.16 |

FOREIGN PATENT DOCUMENTS

| | | |
|---|---|---|
| 0037269 | 10/1981 | European Pat. Off. . |
| 3347680 | 8/1984 | Germany . |
| 3543537 | 4/1986 | Germany . |

OTHER PUBLICATIONS

Int. Publ. WO 91/12413 (Aug. 1991).

*Primary Examiner*—Weilun Lo

*Attorney, Agent, or Firm*—Collard & Roe, P.C.

[57] ABSTRACT

A valve drive for controlling gas exchange valves of an internal combustion engine having a cylinder head, a valve stem and a longitudinal tappet axis including a camshaft having a first cam with a first cam profile and a second cam with a second cam profile greater than the first cam profile. The second cam has two cam members which abut both sides of the first cam. A cup-shaped tappet is slidably disposed within the cylinder head for engaging the two cam members. A central tappet is disposed within the cup-shaped tappet for engaging the first cam. A lash adjuster is disposed within the central tappet and supported against the valve stem. A hydraulic switching arrangement is disposed between the cup-shaped tappet and the central tappet for selectively moving the valve stem according to the first and second cam profiles. The switching arrangement includes contours within one of the tappets oriented transverse to the longitudinal tappet axis, and radially-displaceable convex drivers within the other of the tappets for selectively engaging the concave contours when the cams are positioned at their base circles. A hydraulically-driven locking element movably supported in a plane oriented transverse to the tappet longitudinal axis selectively displaces the drivers into the concave contours to lock the tappets together and move the valve stem according to the second profile. The locking element also displaces the drivers out of the concave contours to unlock the tappets from each other and move the valve stem according to the first cam profile.

6 Claims, 5 Drawing Sheets

DRIVE FOR GAS EXCHANGE VALVES, PREFERABLY INLET VALVES FOR RECIPROCATING INTERNAL COMBUSTION ENGINES

BACKGROUND OF THE INVENTION

1. Field of the Invention

The invention relates to a valve drive for charge exchange valves, preferably inlet valves of reciprocating internal combustion engines. The valve drive includes two cams having different stroke characteristics for slight and maximum opening, whereby cam halves of the second cam abut the first cam on both sides. A cup tappet is guided in the cylinder head which selectively engages the cam halves of the second cam. A central tappet, guided in the cup tappet, engages the first cam. A mechanical or hydraulic lash adjuster is arranged within the central tappet where it is supported against the valve. A hydraulically-switchable driving arrangement is arranged between the central tappet and the cup tappet and has radially-guided, displaceable drivers in one of the tappets. The drivers are engageable in counter contours of the other tappet within the range of the base circles of the two cams.

2. The Prior Art

Valve drives of the above-specified type with an adjustable stroke and two cams with different stroke characteristics are known from published specification WO 91/12413, especially FIGS. 4 to 6 thereof. A mechanical driving device is arranged between the cup tappet and the central tappet, for coupling the two tappets together. The driving device has driving pins, which are supported in the cup tappet, and are acted upon hydraulically and displaced radially inwardly against a spring force. The pins engage an annular surface on the central tappet, which faces the camshaft.

When the driving device is inactive, the slight stroke is transmitted to the valve by the first cam. When the device is active, the greater stroke is transmitted by the second cam. The engagement of the driving pins in the annular surfaces on the central tappet is possible only when both cams pass through their base circles. For this purpose, the base circle of the first cam has to be relatively larger than the second cam in order to assure the required play between the annular surface on the central tappet and the engagement contour of the driving pins for engagement. In the active condition of the second cam, during each pass through the base circles, a change in engagement occurs between the first cam and the driving pins on the annular surface on the central tappet. It is known also from FIGS. 5 and 6 of said published specification to provide the central tappet with a hammer-shaped engagement head projecting beyond the cup tappet, with the rolling surface of said head corresponding approximately to the diameter of the cup tappet. The head is guided between the cam halves of the cam for the minor stroke.

From U.S. Pat. No. 5,090,364, particularly FIGS. 8 to 12 thereof, there is known a tappet arrangement for two valves to be actuated in parallel, with a driving device for alternating between two cams with different stroke characteristics. A mechanical driving device, by means of which the two tappets can be coupled, is arranged within an outer tappet that engages both valves. A central tappet is displaceable within the outer tappet. When the driving device is inactive, the minor stroke is transmitted to the valves by the halves of a first cam, and when the driving device is active, the maximum stroke is transmitted by a second cam arranged between the halves of the first cam.

The driving device has balls supported in a central guide of the outer tappet. The balls are displaceable radially outwardly and engageable with an inwardly slanted annular surface on the central tappet, which faces away from the camshaft. The displacement and support of the balls in the engaging position is accomplished by means of a locking slide. The locking slide is displaceable against an opposing spring force by admission of pressure, and concentrically guided in the central guide of the outer tappet.

A driving device of the above-mentioned design, with a locking element arranged in the center, cannot be used in a switchable cup tappet having the usual dimensions and a cylindrical outer shape. The cup tappet actuates a valve by engagement, for example along its axis with an automatic lash adjuster. Furthermore, valve drives of the type specified above are known also from German Patents DE 35 45 537 A1 and DE 33 47 680 A1, where a controllable hydraulic cushion between the cup tappet and the central tappet forms the driving device.

SUMMARY OF THE INVENTION

The invention is based on the object of designing a driving device for valve drives that can be arranged in a cup tappet of the usual dimension for a valve preferably having a hydraulic lash adjuster.

It is a further object to provide such a driving device in which, in the locked position, such device has self-centering drivers producing a complete form-lock between the tappets.

It is another object to provide a driving device in which the locked condition is releasable preferably by means of alternate pressure medium admission to the driving device.

According to the invention, said problem is solved by a valve drive for charge exchange valves, preferably inlet valves of reciprocating internal combustion engines. Two cams having different stroke characteristics for slight and maximum opening are associated with a valve on a camshaft, whereby cam halves of the second cam abut the first cam on both sides. A central tappet, which is guided in the cup tappet, engages the first cam. A mechanical or hydraulic lash adjuster is arranged in the tappet engaging the cam for slight opening and supported against the valve. A hydraulically-switchable driving arrangement is arranged between the central tappet and the cup tappet and has radially-guided, displaceable drivers in one of the tappets. The drivers are engageable in counter contours of the other tappet within the range of the base circles of the two cams.

The drivers are provided with a convex engagement contour and displaceable or lockable by means of different contours of an associated, hydraulically displaceable locking element. Either concave inner contours on the cup tappet or concave outer contours on the central tappet are associated with the drivers in a plane transverse to the axis of the tappets. The locking elements are displaceably supported in a plane transverse to the tappet axis.

The arrangements of the locking elements, in the locked position, result in self-inhibiting driving devices, which can be realized in cup tappets of the usual dimensions with a centrally arranged, hydraulic lash adjuster. In the locked position, all embodiments have drivers centering in a form-locked way between the tappets to be driven. The aforementioned centering function results from the convex engagement contours on the drivers and the concave counter contours, grooves or depressions, on the tappets. Furthermore, such function permits the valve drive to be designed with full coupling of the two tappets by means of the drivers, whereby the other tappet is disengaged from the cam for slight opening. This assures that when the cam for maximum opening is active, that cam is exclusively engaged. The drivers are balls and the locking elements are arranged outside the plane of displacement (SE) of the drivers, engaging the latter.

It is advantageous if the locking elements are alternatively displaceable by means of pressure media and do not have to be maintained in the locked condition against spring force. For the locked condition, insensitivity is obtained in connection with the self-inhibition of the drivers against brief pressure drops when the locking slide is acted upon for locking the drivers.

BRIEF DESCRIPTION OF THE DRAWINGS

The advantages of embodiments according to the further claims are specified in the description.

Exemplified embodiments of the invention are described in the following by reference to the drawings, in which.

DETAILED DESCRIPTION OF THE PREFERRED EMBODIMENTS

Figures 1A, 1B:
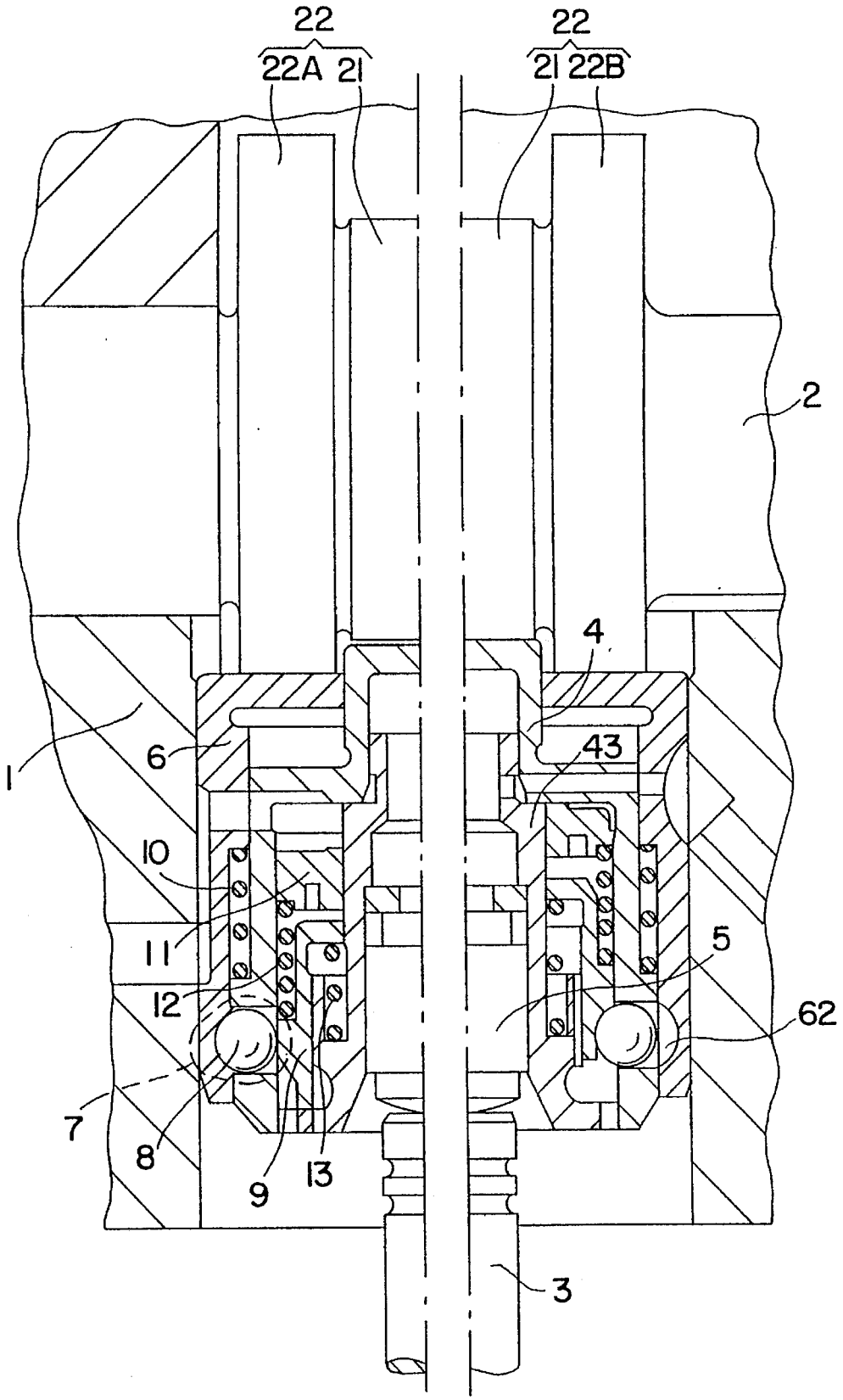
FIGS. 1A and 1B are longitudinal sectional views through a valve drive according to the invention with an axially displaceable locking element.
Figure 2A:
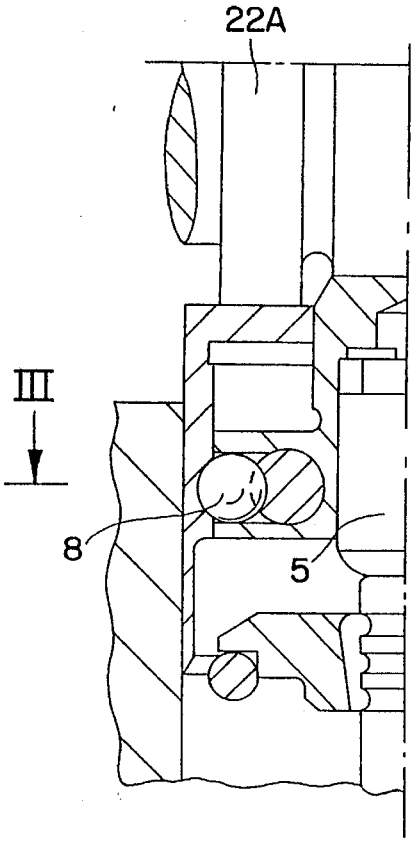
FIGS. 2A and 2B are longitudinal sectional views through a valve drive with tangentially arranged, displaceable locking elements, and with drivers disposed on the outside of the central tappet.
Figure 2B:
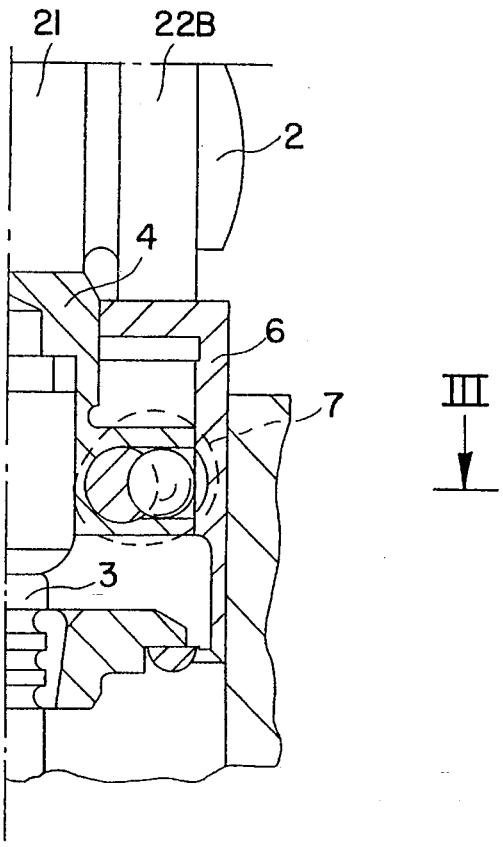

FIGS. 1A and 1B show a valve drive having a camshaft 2 supported within a cylinder head 1. Camshaft 2 has one cam 21 for slight opening and a pair of cams 22A and 22B for maximum opening of a valve 3. The transmission of stroke movements by each of cams 21, 22A and 22B to valve 3 takes place via a first central tappet 4 by means of a pressure sleeve 43 and a hydraulic lash adjuster 5 of the known type, which is arranged in sleeve 43. In this arrangement, said device acts in a lash-adjusting manner for the valve train controlling the valve stroke from cam 21 or cams 22A and 22B. Tappet 4 engages cam 21 and is displaceably supported in a cylindrical cup tappet 6 guided in cylinder head 1. Cup tappet 6 has a hydraulically controllable driving arrangement 7.

Drivers 8 are balls, which are guided in cross bores in central tappet 4. A locking element 9, which is hydraulically displaceably against a spring force, is supported in the annular space between the outside diameter of pressure sleeve 43 and the inside guide of central tappet 4. A displacement contour and a locking contour are present on the outside surface of said element. Driver 8 are radially displaceable and lockable by means of said contours. In its guide bore for tappet 4, cup tappet 6 has a concave inside contour 62 designed as an annular contour facing valve 3, in which annular contour driver 8 can be engaged and locked by means of locking element 9 within the range of rotation of the parallel base circles of two cams 21, 22A and 22B. The full engagement of drivers 8 in inside contour 62 of cup tappet 6 is shown in FIG. 1A. Locking element 9 is displaced by admission of pressure of clamping piston 11 via a spring 12 against the force of a return spring 13. Drivers 8, designed as balls, rest completely against the locking contour of locking element 9. In this condition, tappet 4 is disengaged from cam 21. The valve stroke is determined by cam 22 with its halves 22A and 22B, which are in engagement with cup tappet 6.

When the pressure of clamping piston 11 is relieved, spring 12 is relaxed, and return spring 13 displaces locking element 9 upwardly, with simultaneous release of drivers 8 radially inwardly (see FIG. 1B). When driving arrangement 7 is not active, the valve stroke is determined by cam 21 and cup tappet 6 performs its stroke against the force of a spring 10, which is supported against cylinder head 1, but preferably against tappet 4. In the latter case, spring 10 has to be designed for only one spring deflection conforming to the difference between the strokes of cam 21 and cams 22A and 22B. It would be conceivable also to admit pressure directly axially to locking element 9, in which case clamping piston 11 and spring 12 (not shown) could be dispensed with.

FIGS. 2A, 2B, 3A, and 3B show schematic views of a design basically similar to the one shown in FIG. 1. However, here, hydraulic lash adjuster 5 is directly guided in central tappet 4, and outside drivers 8 are locked by locking elements 9, which are tangentially displaceable preferably by means of oil pressure.

Figure 3A:
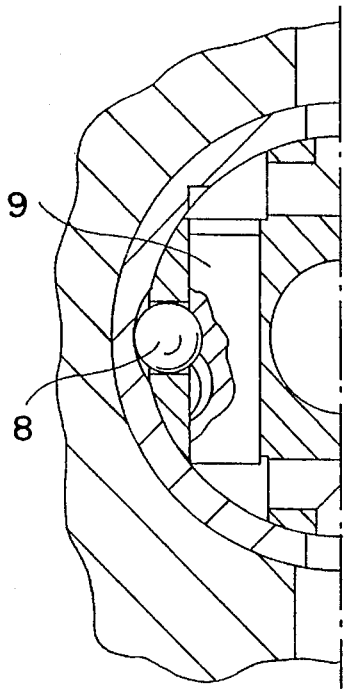
FIGS. 3A and 3B are cross-sectional views along the line III—III from FIGS. 2A and 2B.
Figure 3B:
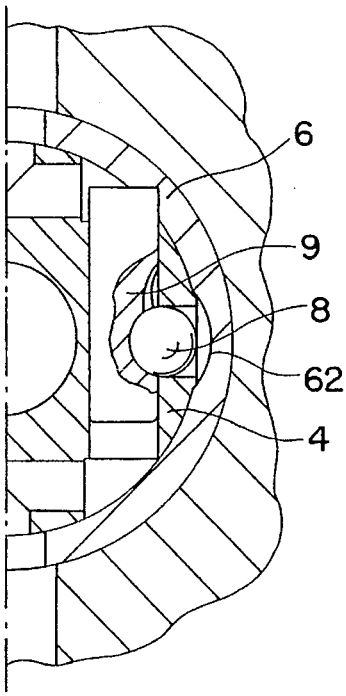

FIG. 3A shows the locked condition, with drivers 8 engaging concave inner contours, i.e. circular or spherically-shaped recesses, of cup tappet 6, and blocked in said position by the locking contour on locking element 9. On the right-hand side, the engagement-free condition is shown. Drivers 8 each rest in a correspondingly retracted contour in their associated locking element 9, or can give way in said position without resistance and only extend in their guide bores in central tappet 4.

Figure 4A:
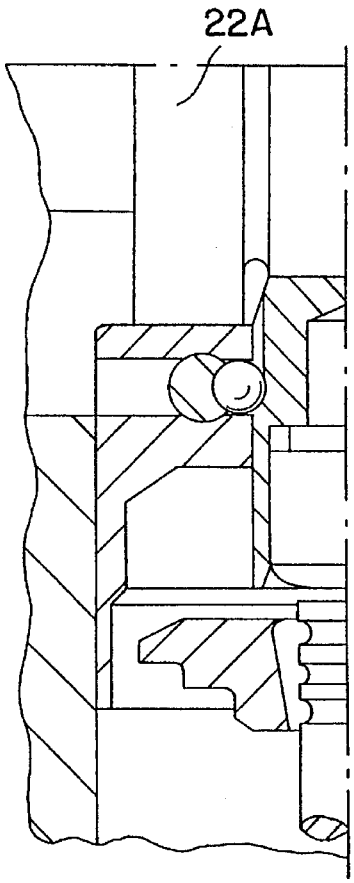
FIGS. 4A and 4B are longitudinal sectional views through a valve drive with tangentially arranged, displaceable locking elements and with drivers disposed on the inside of the cup tappet.
Figure 4B:
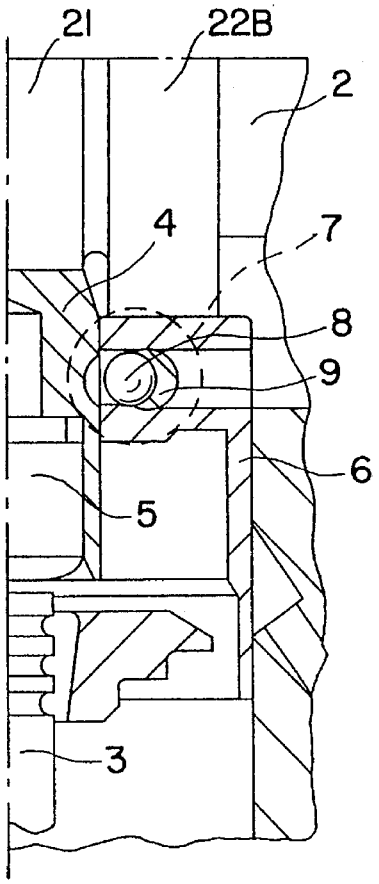

FIGS. 4A and 4B show in a schematic drawing a design similar to the one shown in FIGS. 2A, 2B, 3A, and 3B. However, driving arrangement 7 is realized here by means of inside drivers 8 guided in cup tappet 6 and with the tangentially displaceable locking elements 9. Drivers 8 engage concave outer contours on the circumference of central tappet 4. FIG. 4A shows the engaged condition and FIG. 4B shows the engagement-free condition. The transmission ratios of the strokes from cam 21, 22A and 22B, respectively, to valve 3 are described for FIGS. 2 to 4 in the same way as for FIG. 1.

Figure 5:
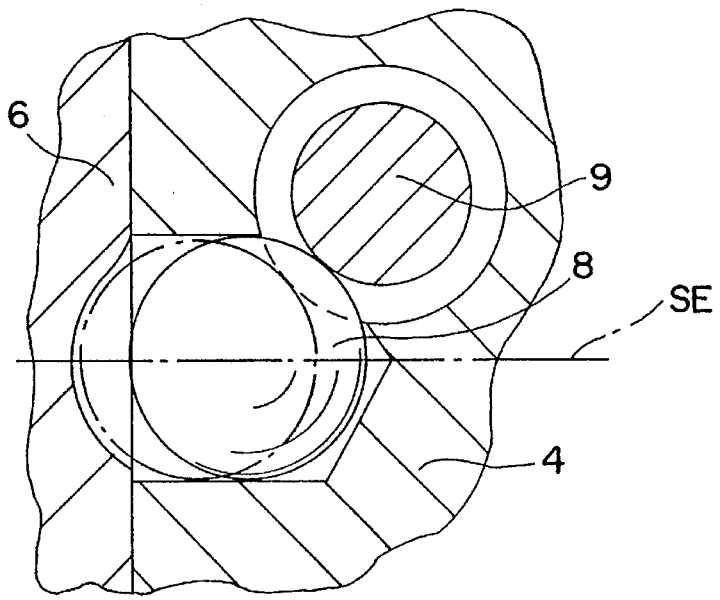
FIG. 5 is a side elevational view of a locking element engaging the driver outside of the plane of displacement of the driver.

FIG. 5 shows that locking elements 9 do not have to engage the plane of displacement SE (center plane) of drivers 8 in order to displace or lock said drivers. With such an association of driver 8 and locking element 9, driving arrangement 7 has a smaller dimension in the diameter plane. It is possible also within the framework of the invention to displace and lock the drivers by means of rotatable or swivel-mounted locking elements in order to controllably couple to the two tappets (not shown).

Figure 6A:
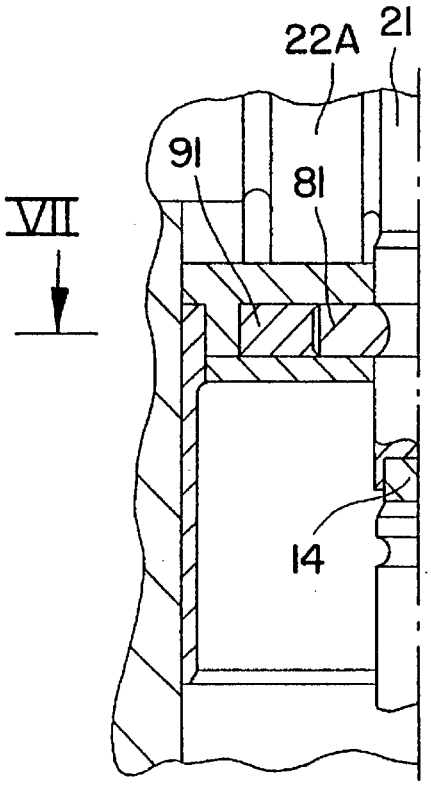
FIGS. 6A and 6B are longitudinal sectional views through a valve drive with tangentially arranged locking elements and with inside drivers of a static valve lash adjuster.
Figure 6B:
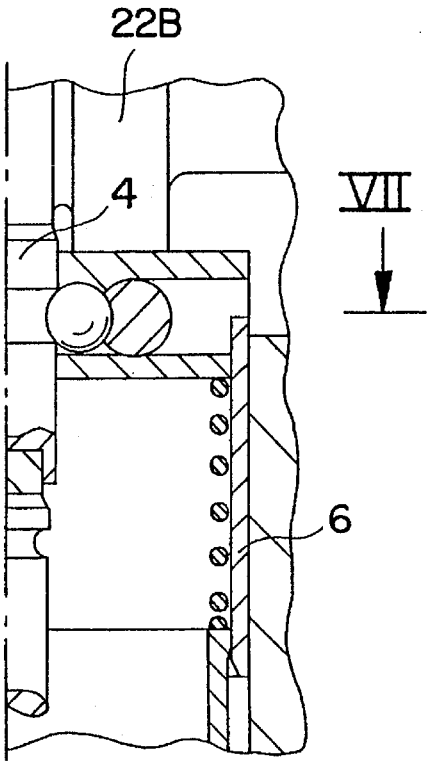

FIGS. 6A and 6B show a valve drive similar to the design according to FIG. 4 with a static valve lash adjuster and the addition of a spacing piece 14, which is insertable in central tappet 4. Spacing pieces 14 are made available in the known manner at different levels and selectively inserted depending on the play.

Figure 7A:
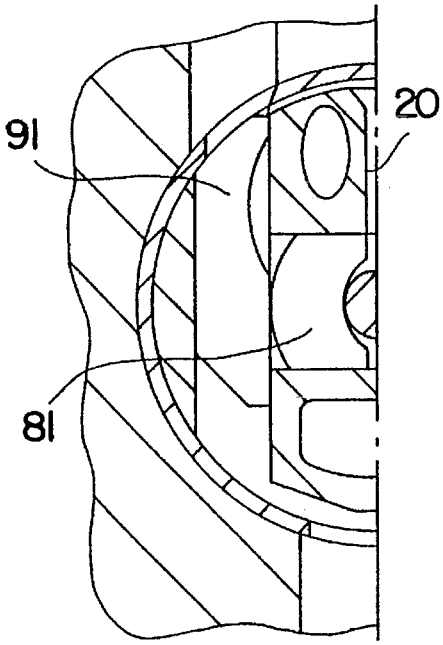
FIGS. 7A and 7B are cross-sectional views taken along the line VII—VII from FIGS. 6A and 6B.
Figure 7B:
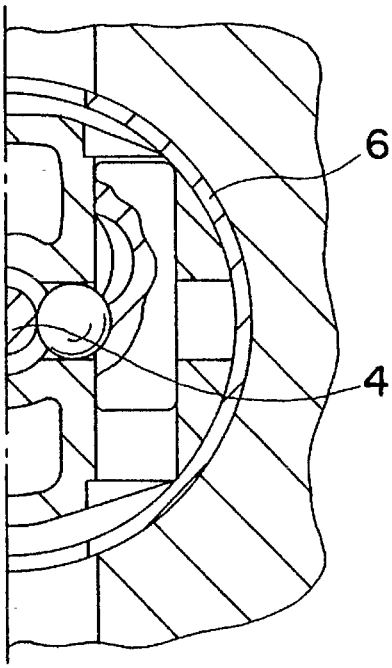

FIGS. 6A and 7A show the drivers as plate-shaped drivers 81 and FIGS. 6B and 7B show drivers 8 designed as balls as described above. Driver 81 slides in a rectangular guide of cup tappet 6 and has a curved contour for engaging a groove of central tappet 4. Locking element 91 is plate-shaped as well and displaceably arranged in a tangentially-extending rectangular guide as well. Locking element 91 is displaced by being alternately acted upon. For releasing the engagement of driver 81, its engagement contour has to be acted upon for simultaneously acting upon locking element 91. For this purpose, provision is made for a duct 20 feeding into the plane of engagement.

Figure 8:
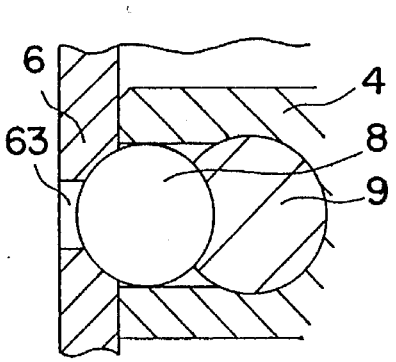
FIG. 8 is a side elevational view of a cutout of a cup tappet with a concave inside contour and a bore corresponding with the driver axis.

FIG. 8 shows an enlarged cutout of a cup tappet 6, showing that the concave inside contour on the cylindrical wall of cup tappet 6 is provided with a through-extending bore 63 (for driver 8, which is a ball). A precise association of the position and treatment of the seat of the driver is made possible by means of bore 63. Furthermore, self- or re-centering by driver 8 is automatically possible if the seat is worn. The cutout shows the cooperation between driver 8 and locking element 9. In the present illustration, central tappet 4 is locked against any movement of stroke in cup tappet 6.

Figure 9:
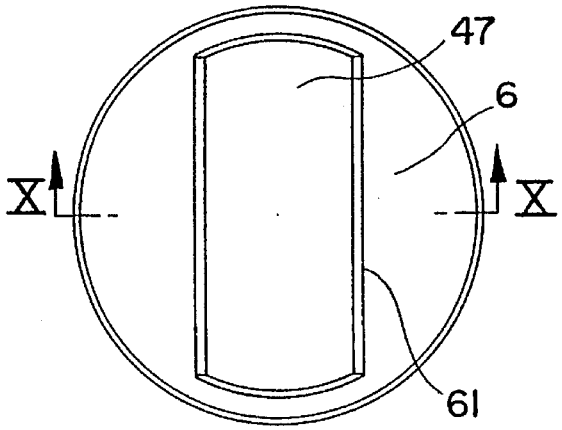
FIG. 9 is a top plan view of a cup tappet with an engagement head extending almost across the diameter of the cup tappet.
Figure 10A:
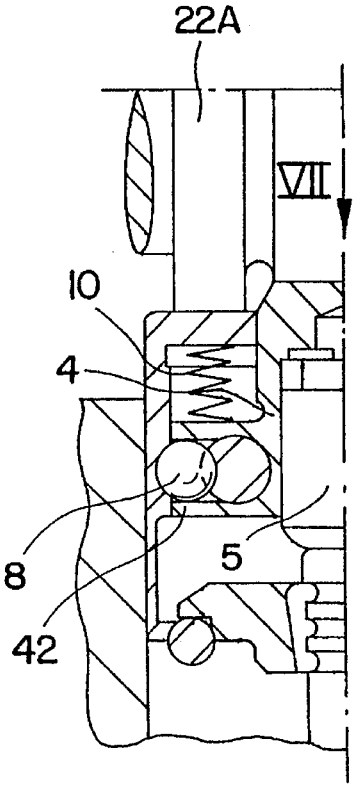
FIGS. 10A and 10B are longitudinal sectional views of a cup tappet taken along the line X—X from FIG. 9.
Figure 10B:
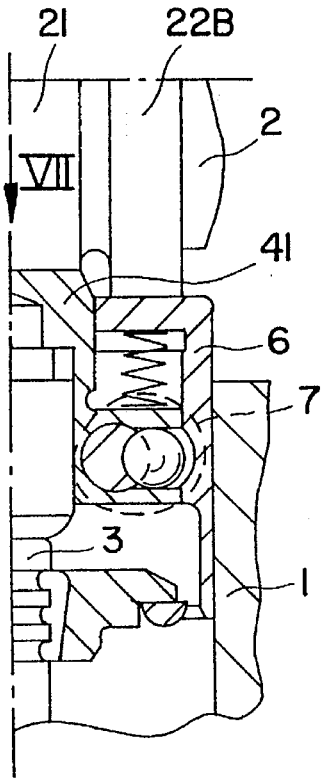

Furthermore, as shown in FIGS. 9, 10A and 10B, central tappet 4 can have an engagement head 41 extending transversely to camshaft 2 and, if need be, fully across the diameter of cup tappet 6, said head being adapted to the width of cam 21 for slight opening. With its contour shown, engagement head 41 extends through a corresponding opening 61 in cup tappet 6 and up to guide 42 of central tappet 4 with driving arrangement 7.

The engaging surfaces of cams 21, 22A and 22B engaging cup tappet 6 and/or central tappet 4 or engagement head 41 of the latter can be designed curved in the same or different ways across the axis X—X shown in FIG. 9. In this way, the engagement ratios between two cams 21 or their cam halves 22A and 22B and tappets 4 and 6 can be suitably designed on the limited surface of the diameter of cup tappet 6.

The maximum opening stroke for valve 6 can be the same with two cams 21, 22A, 22B or different. However, the stroke of cam 21 must not be greater than the stroke of cam halves 22A and 22B at any position of rotation of camshaft 2. With such a design, two cams 21 and 22 can have the same maximum stroke with, however, different opening characteristics. Springs 10 have to be designed for a spring deflection corresponding with difference between the strokes of cams 21 and 22.

What is claimed is:

1. A valve drive for controlling gas exchange valves of an internal combustion engine having a cylinder head, a valve stem and a longitudinal tappet axis comprising:

a camshaft having a first cam with a first cam profile and a second cam with a second cam profile greater than said first cam profile, said second cam comprising two cam members which abut both sides of said first cam;

a cup-shaped tappet slidably disposed within the cylinder head for engaging said two cam members;

a central tappet disposed within said cup-shaped tappet for engaging said first cam;

a lash adjuster disposed within said central tappet and supported against the valve stem; and a hydraulic switching arrangement disposed between said cup-shaped tappet and said central tappet for selectively moving the valve stem according to said first and second cam profiles comprising:

(i) concave contours within one of said tappets oriented transverse to the longitudinal tappet axis;

(ii) radially-displaceable convex drivers within the other of said tappets for selectively engaging the concave contours when said cams are positioned at their base circles; and (iii) a hydraulically-driven locking element movably supported in a plane oriented transverse to the longitudinal tappet axis for selectively displacing said drivers into the concave contours to lock said tappets together and move the valve stem according to said second cam profile and displacing said drivers out of the concave contours to unlock said tappets from each other and move the valve stem according to said first cam profile.

2. A valve drive for controlling gas exchange valves of an internal combustion engine having a cylinder head, a valve stem and a longitudinal tappet axis comprising:

a camshaft having a first cam with a first cam profile and a second cam with a second cam profile greater than said first cam profile, said second cam comprising two cam members which abut both sides of said first cam;

a cup-shaped tappet slidably disposed within the cylinder head for engaging said two cam members;

a central tappet disposed within said cup-shaped tappet for engaging said first cam;

a lash adjuster disposed within said central tappet and supported against the valve stem; and a hydraulic switching arrangement disposed between said cup-shaped tappet and said central tappet comprising:

(i) concave contours within one of said tappets oriented transverse to the longitudinal tappet axis;

(ii) radially-displaceable convex drivers within the other of said tappets for selectively engaging the concave contours when said cams are positioned at their base circles; and (iii) hydraulically-driven locking elements movably supported in a plane oriented transverse to the longitudinal tappet axis, said locking elements having contours different than said drivers for displacing said drivers to selectively lock said tappets together to move the valve stem according to one of the first and second cam profiles.

3. The valve drive according to claim 2, wherein upon locking said tappets together with said drivers, said central tappet is disengaged from said first cam during at least part of a rotation of said camshaft.

4. The valve drive according to claim 2, wherein said convex drivers are balls.

5. The valve drive according to claim 2, wherein said drivers are radially-displaced within a displacement plane (SE); and wherein said locking elements reside outside of the displacement plane (SE).

6. The valve drive according to claim 2, wherein said locking elements are driven by a pressurized media.

* * * * *